United States Patent [19]

Beauquet et al.

[11] Patent Number: 4,472,695

[45] Date of Patent: Sep. 18, 1984

[54] BAND PASS FILTER TUNABLE TO A PREDETERMINED NUMBER OF DISCRETE FREQUENCIES SPRED OVER A BROAD FREQUENCY BAND

[75] Inventors: Gilles Beauquet, St. Brieuc; Vasudeo Devarhubli, Fresnes; Gérard Dubost, Rennes; Michel Nicolas, Paris, all of France

[73] Assignee: Societe SNECMA, Evry Cedex, France

[21] Appl. No.: 406,233

[22] PCT Filed: Dec. 9, 1981

[86] PCT No.: PCT/FR81/00158

§ 371 Date: Aug. 5, 1982

§ 102(e) Date: Aug. 5, 1982

[30] Foreign Application Priority Data

Dec. 10, 1980 [FR] France ..... 80 26217

[51] Int. Cl.[3] ..... H01P 1/202; H01P 1/205; H01P 7/04

[52] U.S. Cl. ..... 333/207; 333/223; 333/225; 333/235

[58] Field of Search ..... 333/202–212, 333/219–235, 245, 248

[56] References Cited

U.S. PATENT DOCUMENTS

| | | | |
|---|---|---|---|
| 3,444,485 | 5/1969 | Okean | 333/207 |
| 3,569,874 | 3/1971 | Kuroda | 333/207 |
| 3,927,347 | 12/1975 | Farney | 333/228 X |
| 4,004,257 | 1/1977 | Geissler | 333/207 |
| 4,066,988 | 1/1978 | Karp | 333/209 |

FOREIGN PATENT DOCUMENTS

| | | | |
|---|---|---|---|
| 2805965 | 8/1978 | Fed. Rep. of Germany | 333/203 |

*Primary Examiner*—Marvin L. Nussbaum
*Attorney, Agent, or Firm*—Shenier & O'Conner

[57] ABSTRACT

Coaxial filter having at least one of the internal and external conductors which is divided into sections ($S_1$ to $S_4$) separated by breaks having to form of annular slits whose thickness is very slight in relation to the wavelength.

Each section comprises at least one reactive tuning element such as an open or short-circuited coaxial line portion and at least one switch element located in the vicinity of the corresponding break in order selectivity to short-circuit the said break or bring about the insertion of the corresponding reactive tuning element in response to electronic control devices.

Application to telecommuncations.

7 Claims, 3 Drawing Figures

BAND PASS FILTER TUNABLE TO A PREDETERMINED NUMBER OF DISCRETE FREQUENCIES SPRED OVER A BROAD FREQUENCY BAND

The present invention concerns a band pass filter tunable to a predetermined number of discrete frequencies spread over a broad frequency band, comprising at least one resonant coaxial cavity defined by an external conductor and an internal conductor.

Prior art contains numerous examples of band pass filters made from at least one resonant cavity constituted by a coaxial line comprising an internal conductor and an external conductor and terminating by a short circuit, with input or output coupling devices associated with the cavity.

Generally, the pass band of such a filter is very narrow and the devices for tuning to a given frequency of said band are comprised by mechanical adjustment devices.

Also manufactured have been ultra high frequency band pass filters constituted by a single coaxial line divided into several adjacent resonant cavities separated by coupling units such as pistons, with a tuning device being provided for each resonator and a coupling adjustment device being associated with each coupling unit between two successive resonant cavities.

Such a type of filter may also comprise a standard element capable of being adapted to slightly different frequencies in a frequency band, this by means of manual adjustment of the position of the pistons constituting coupling units for example, or by acting on other parameters of the system's geometry.

Also known are ultra high frequency filters with adjustable tuning rods comprising wave guide segments divided into several adjacent resonators by curtains of conducting rods and including a mechanical tuning device for each resonator such as an adjustable-position dielectric pin and a coupling adjustment device for each curtain of rods, such as a metallic screw.

With such a filter, it is possible to adjust the characteristics of a standard element from the outside by manually activating the mechanical adjustment parts, thereby adapting the pass band to a predetermined channel within a frequency range. It is not possible during operation, however, to modify the characteristics of the filter so as to pass instantaneously from one discrete frequency to another discrete frequency defined within a broad band of frequencies of one or two octaves.

The present invention aims specifically at making it possible to produce a band pass filter, basically constituted by a coaxial cavity, whose practically instantaneous tuning is possible for a certain number of discrete frequencies spread over a broad frequency band.

According to the invention, a coaxial band pass filter is thus essentially characterized in that at least one of the internal and external conductors of the coaxial cavity is divided into sections separated by breaks constituted by annular slits whose thickness is very slight in comparison with the wave length corresponding to the average frequency of the pass band and in that each section comprises at least one reactive tuning element and at least one commuting element located in the vicinity of the break in the corresponding section so as selectively to short-circuit the said break or to insert the reactive tuning element for the corresponding section in response to electronic actuating devices.

Each reactive tuning element is constituted by a portion of coaxial line wich is open or short-circuited in a section of internal conductor or external conductor.

The revolution cavities formed in sections of internal conductor or external conductor so as to achieve an open or short-circuited coaxial line have transversal dimensions which are very much larger than the thickness of one break but small in comparison to the wave length corresponding to the average frequency of the pass band.

Thus, in accordance with the present invention, thanks to a coaxial resonant cavity with predetermined geometric characteristics, it is possible to achieve, without manually actuating mechanical adjustment elements, an almost instantaneous tuning of the cavity to a discrete tuning frequency selected from among a large number of predetermined frequencies spread over a broad frequency band, thanks to a selective actuation for each of the commutators associated with the breaks, which by means of an all-or-nothing command make it possible to close a break or open a break by placing the associated reactive element into service. As a result, with N breaks the number of discrete frequencies for which it is possible to achieve a tuning of the resonant cavity amounts to $2^N$, taking into account the possible combinations of status (open or closed) of the N breaks, brought about with the help of the associated commutators actuated by numerical electronic tuning devices.

To good advantage, for each section, several commutator elements supplied in parallel are distributed evenly along the length of the break to accomplish the short-circuiting of the said break or the insertion of a reactive element.

In accordance with one embodiment, the commutator elements are constituted by electromagnetic relays whose dimensions are small vis-à-vis the average operational wave length, and which are located in the immediate vicinity of the annular slits constituting the breaks between sections.

According to another preferred embodiment, the commutator elements are constituted by PIN diodes located in the immediate vicinity of the annular slits constituting the breaks between sections.

The commutator elements are actuated by direct current from conducting wires which are insulated and uncoupled from the high frequency and incorporated in the internal or external conductors.

Production of a band pass filter according to the invention is facilitated if the internal and external conductors of the coaxial cavity are composed of superimposed metallic elements screwed one into the other.

In accordance with a particularly worthwhile embodiment, the dimensions of the coaxial cavity, of the reactive elements of the N sections and the positions of the N breaks are determined in such a way as to define an approximately constant law $\Delta f/f$, where f designates any one of the $2^N$ discrete tuning frequencies obtained by the selective insertion of the N reactive elements and $\Delta f$ represents the average difference between the said frequency f and the adjacent frequencies among the $2^N$ possible frequencies.

The band pass filter in accordance with the invention may be used in the widest range of applications but is advantageously applied to the connection, to a single aerial, of several transmitters or receivers operating on different frequencies.

Other characteristics and advantages of the invention will be made clear in the following description of particular embodiments, provided by way of nonrestrictive examples with reference to the attached drawings, in which.

Figure 1:
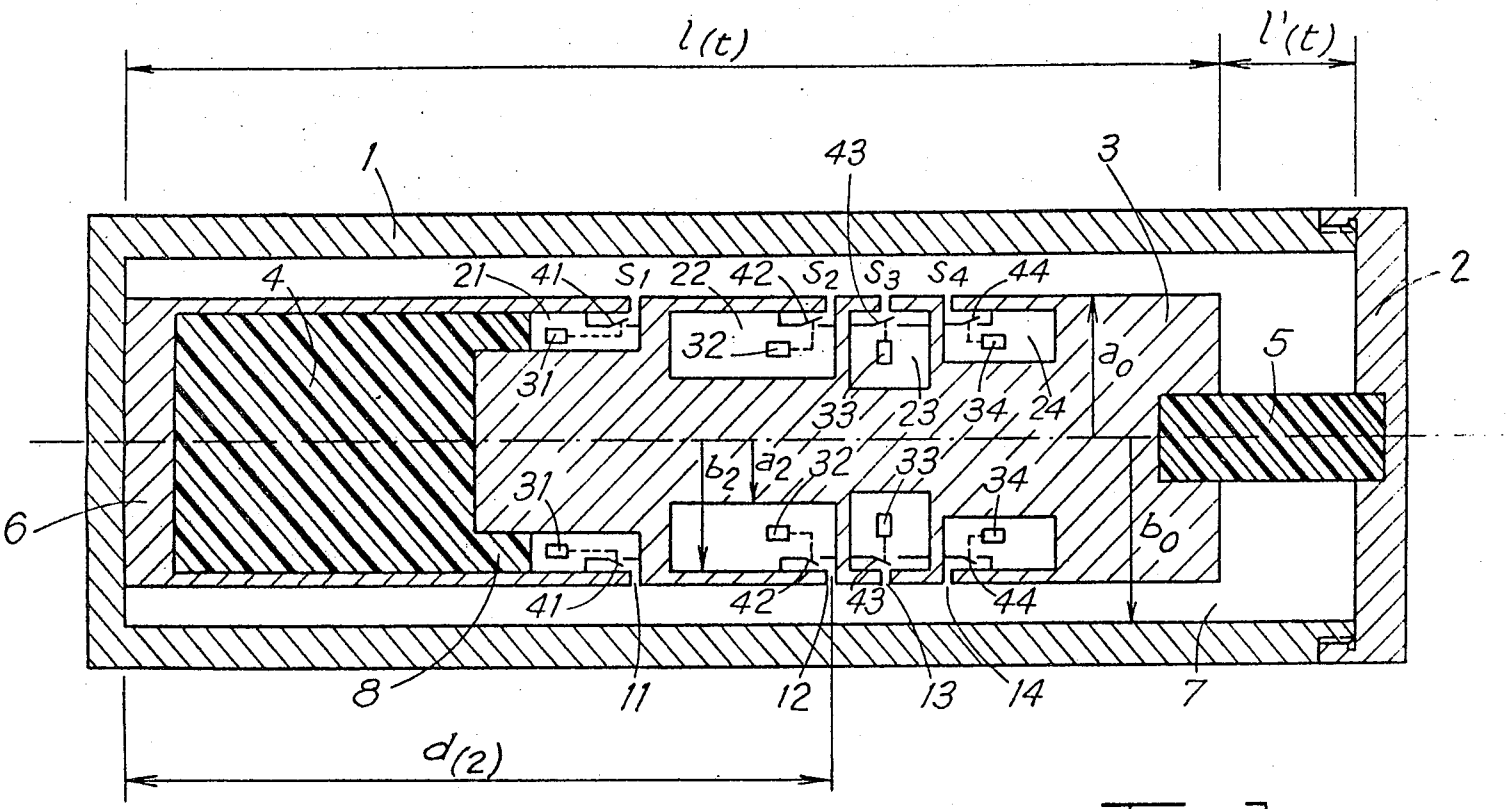
FIG. 1 is a schematic axial cross-section view of a first embodiment of a band pass filter according to the invention.

Reference is first made to FIG. 1 which represents the basic configuration of a band pass filter according to the invention which is divided, by way of example, into four sections $S_1$ to $S_4$.

The coaxial cavity of the filter of FIG. 1 has a body or external conductor 1 closed by a cover 2 which is screwed on to the body 1. The internal conductor 3 is divided into sections ($S_1$ to $S_4$) separated by breaks 11 to 14 having the form of annular slits whose thickness e is very slight with respect to the wave length corresponding to the average frequency of the pass band of the filter. This configuration is possible if the internal conductor 3 and external conductor 1 are, for example, in the form of several superimposed segments such as 301, 302, 303 or 101, 102, 103 respectively (FIG. 3) screwed into one another. Thus one part of external conductor 101 can be connected to a part 102 by a screw connection 101*a*, 102*b*, with part 102 superimposed over a part 103 itself being connected to the latter by a screw connection 102*a*, 103*b*. In like manner, segments 301, 302, 303 of internal conductor 3 may be assembled together by parts 301*a*, 302*b* and 302*a*, 303*b* screwed into one another. In this case, the positions of the planes of the joints are determined only by machining requirements, with only the location of the breaks such as 12, 13, 12', 13' as well as the shape of the cavities such as 22, 23, 22', 23' playing a role in functioning with respect to the electromagnetic waves. Consequently, in FIGS. 1 and 2 the lines of separation between the various pieces making up the internal conductor 3 and external conductor 1 of the coaxial cavity have not been represented, but only the breaks such as 11 to 14, which define the different sections $S_1$ to $S_4$.

The external metallic conductor 1 and internal metallic conductor 3 may for example be made of brass. An insulating cylinder 5, of polytetrafluoroethylene, for example, is supported by the cover 2 and guarantees the centering of the internal conductor 3 with respect to the body 1 while exerting an appropriate amount of pressure on the various segments making up the internal conductor 3.

Generally speaking, the coaxial cavity behaves like a quarter wave line with resonance largely for the average frequency of the pass band of the filter. As FIG. 1 shows, each section $S_1$ to $S_4$ comprises a tuning reactance 21 to 24 incorporated in the inside conductor 3 and which can be placed into service at the corresponding break 11 to 14. A tuning reactance may be constituted by a short-circuited coaxial line (reactances 22, 23, 24) which is equivalent to a self inductance or by an open line (reactance 21) which is equivalent to a capacitance. In FIG. 1, the open coaxial line 21, which constitutes the tuning reactance of the first section $S_1$, is centered by means of a cylindrical sleeve 4 made of a dielectrical material such as polytetrafluroethylene and supported by the metallic bottom 6 of the coaxial cavity which makes the short circuit of the external conductor 1. The tuning reactances of the second, third and fourth sections $S_2$, $S_3$, $S_4$ are themselves constituted by three portions of coaxial lines short-circuited in the air, defined by annular cavities whose shapes and sizes may vary widely. However, so that the coaxial cavity of the filter has sufficiently high coefficients of no load overvoltage, it is necessary to reduce the losses of the circuits, in particular those of the open or short-circuited transmission lines whose input impedances are associated with the tuning reactances. The transversal dimensions of cavities 21 to 24 must therefore have significant transversal dimensions, although they must be small with respect to the wave length so as to avoid TE or TM type parasitic modes.

As will be explained below in greater detail, at least one switch 31, 32, 33, 34 is associated with each break 11, 12, 13, 14 and makes it possible either to short-circuit the said break by closing a contact 41, 42, 43, 44 or to insert the tuning reactance 21, 22, 23, 24 included in the sections $S_1$, $S_2$, $S_3$, $S_4$ corresponding to the break in question. It is thus apparent that the effective tuning frequency of the filter depends on the status of switches 31 to 34 and may be selected from among a large number of discrete frequencies even for a relatively small number N of breaks, since the number of possible discrete tuning frequencies depends on the combination of the different possible statuses of the different breaks and is thus equivalent to $2^N$, with each break either permitting or not permitting the activation of a tuning reactance.

FIG. 1 shows a model cavity which corresponds to $N=4$ and thus has $2^4=16$ discrete tuning frequencies. By way of example, such a cavity may function in the UHF band (225 to 400 MHz).

The dimensions of the coaxial cavity constituting the filter, the position of breaks 11 to 14 and the dimensions of reactances 21 to 24 may be optimalized so as to achieve an approximately constant $\Delta f/f$ law, where f designates any one of the N tuning frequencies and $\Delta f$ is the average difference between that frequency and the adjacent tuning frequencies.

By way of example, provided below are numerical values which, applied to a four-section filter such as the one represented in FIG. 1, make it possible to obtain such a $\Delta f/f$ law which is approximately constant:

For an internal conductor 3 with radius $a_o=32$ mm, an external conductor 1 whose inside radius is $b_o=41.1$ mm, cavity lengths $l_t=245.8$ mm and $l'_t=32$ mm (see FIG. 1), an input capacitance of the open coaxial line (7) of $c_e=2.91$ $p^F$ and an end capacitance 8 of the capacitive reactance 21 associated with the first break 11 of $c_{e1}=2.8$ $p^F$, Table I shows the position d(k) with respect to the bottom of the cavity 6 of the break of rank "k", the dimensions $a_k$ and $b_k$ of the corresponding tuning reactance (i.e., the radii of the coaxial surfaces of the annular cavity defining the tuning reactance) and the capcitance Cp(k) of the break "k" en $p^F$ which makes it possible to best adjust the theoretical and experimental frequencies.

TABLE I

| k | 1 | 2 | 3 | 4 |
|---|---|---|---|---|
| $2a_k$ (mm) | 40.37 | 27.39 | 23.19 | 35.18 |
| $2b_k$ (mm) | 58 | 58 | 58 | 58 |

TABLE I-continued

| k | 1 | 2 | 3 | 4 |
|---|---|---|---|---|
| $d_k$ (mm) | 115 | 159 | 170 | 184 |
| $C_p$ (k) in $p^F$ | 10.29 | 9.48 | 6.80 | 9.90 |

Table II provides a list of the discrete tuning frequencies obtained in the example of a filter with four sections defined above, depending on the status of breaks 11 to 14. The letter F represents a closed, short-circuited break while the letter O represents an open break assuring the insertion of a tuning reactance. For each different combination of statuses of the breaks 11 to 14, Table II indicates in MHz the theoretical frequency $F_t$, the frequency $F_e$ obtained experimentally, and the discrepancy $F_e - F_t$.

TABLE II

| Status of breaks | | | | Theoretical frequencies (MHz) | Experimental Frequencies (MHz) | $F_e - F_t$ |
|---|---|---|---|---|---|---|
| 11 | 12 | 13 | 13 | $F_t$ | $F_e$ | (MHz) |
| F | O | O | O | 226.08 | 226.2 | +0.12 |
| F | O | O | F | 233.09 | 233.1 | +0.01 |
| F | O | F | O | 240.02 | 240.0 | −0.02 |
| F | O | F | F | 247.96 | 247.9 | −0.06 |
| F | F | O | O | 258.36 | 258.6 | +0.24 |
| F | F | O | F | 268.53 | 268.6 | +0.07 |
| F | F | F | O | 278.31 | 278.6 | +0.29 |
| F | F | F | F | 289.67 | 289.7 | +0.03 |
| O | O | O | O | 303.95 | 304.1 | +0.15 |
| O | O | O | F | 314.70 | 314.1 | −0.40 |
| O | O | F | O | 324.47 | 324.9 | +0.43 |
| O | O | F | F | 336.19 | 336.1 | −0.09 |
| O | F | O | O | 353.07 | 352.6 | −0.47 |
| O | F | O | F | 368.91 | 369.1 | +0.19 |
| O | F | F | O | 381.75 | 381.9 | +0.25 |
| O | F | F | F | 396.90 | 396.9 | 0.00 |

Figure 2:
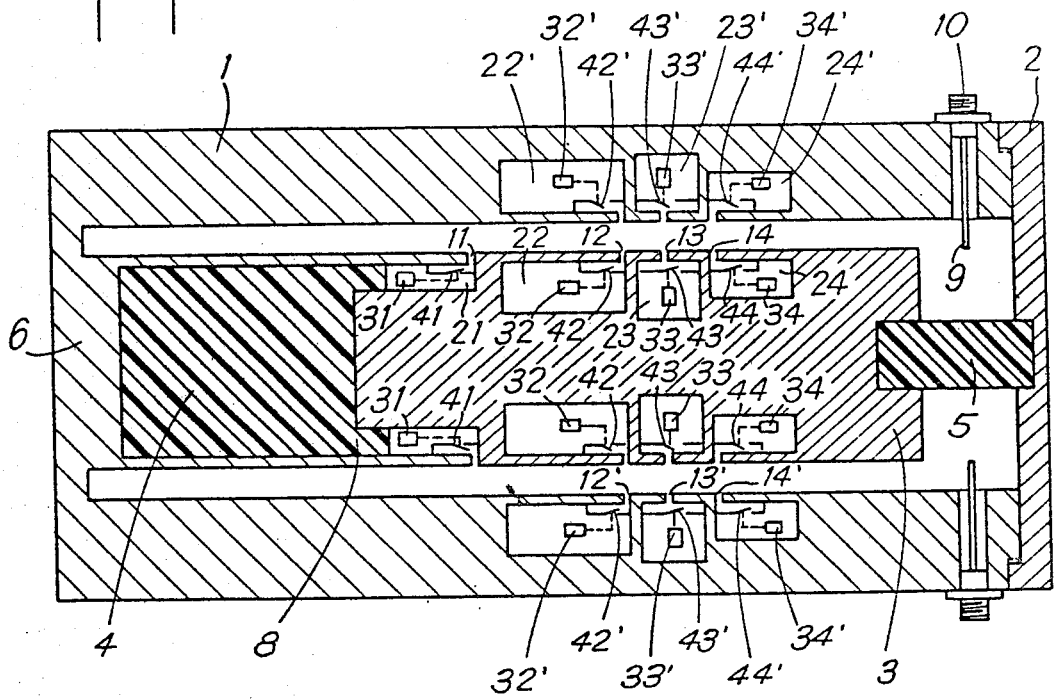
FIG. 2 is a schematic axial cross-section view of a second embodiment of a band pass filter according to the invention.

While FIG. 1 shows an example of a filter with four sections $S_1$ to $S_4$ and four annular slits forming breaks 11 to 14, the invention naturally includes filters of this type which have a different number of sections and thus have a different number of tuning frequencies. FIG. 2 thus represents a coaxial filter comprising seven breaks 11 to 14 and 12' to 14' which make it possible to define $2^t = 128$ discrete frequencies, for example in the same frequency band as the one adopted for purposes of the earlier example provided.

Figure 3:
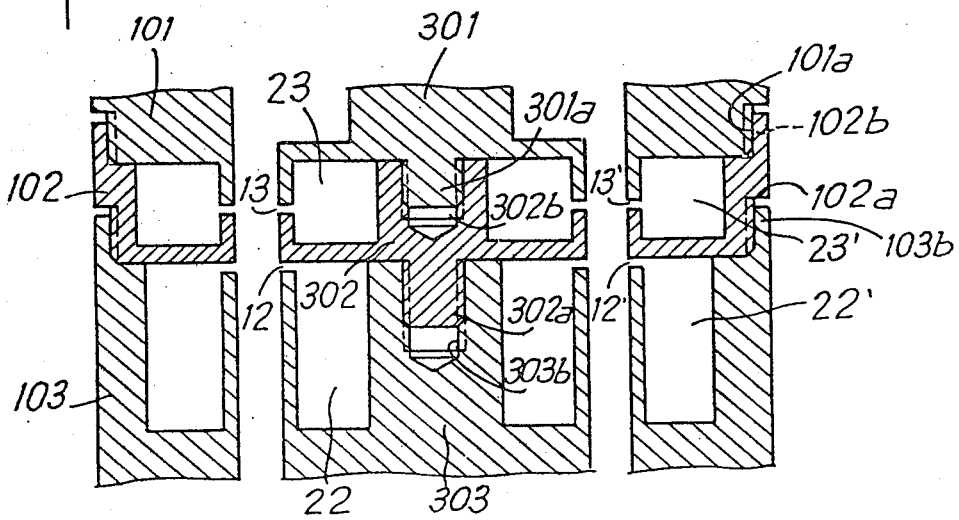
FIG. 3 is a partial axial cross-section view showing the possible assembly of different elements making up the different sections of a filter according to the invention.

As does FIG. 3, FIG. 2 shows also that the breaks may be made in the external conductor 1 as well as in the internal conductor 3 of the coaxial cavity. Moreover, the annular cavities 22', 23', 24' formed in the external conductor 1 to make coaxial lines forming the tuning reactances associated with breaks 12', 13', 14', respectively, are not necessarily identical to those (12, 13, 14) formed in the corresponding internal part of the internal conductor 3. In addition, cavities 12', 13', 14' could also be used alone, independently from cavities 11 to 14 of the internal conductor 3, with the later remaining short-circuited, for example.

The switches 21 to 34, 32' to 34' actuating contacts 41 to 44, 42' to 44' in order to define the open or closed status of a break 11 to 14, 12' to 14' may, for example, be electromagnetic relays. Preferably, however, small PIN diodes are used. Generally speaking, the dimensions of the commutation elements 31 to 34, 32' to 34' must be small vis-à-vis the operational wave length and said commutation elements must be located in the closest possible cavity of the annular slit to be short-circuited.

The switches (31 to 34, 32' to 34') are actuated by direct current by means of insulated wires (not shown) arranged either in the axis of the central element 3, or in the wall of the outside element 1 of the coaxial cavity of the filter. An uncoupling system for the switches fed with direct current, constituted by capacitors, makes it possible to insulate the high frequency from the outside.

The switches (31 to 34, 32' to 34') are preferably each comprised by a number of parts distributed at regular intervals along the corresponding break (11 to 14, 12' to 14') and fed with power in parallel.

In fact, a better distribution of currents is assured for each break such as 11 by a number of short-circuit elements such as 31, 41 distributed symmetrically (for example four elements 31, 41 arranged at 90° angles from one another) and fed with power in parallel.

The electronic circuits making it possible to decide on the selective power supply of the different switches 31 to 34, 32' to 34' determining the status of the breaks 11 to 14, 12' to 14' depending on the discrete tuning frequency selected may be comprised by quite conventional logic circuits.

The filter connections for input and output (transmitter and receiver) are likewise provided conventionally by inductance or capacitance couplings. By way of example, FIG. 2 represents an input or output coupling achieved by means of a small antenna 9 (capacitance coupling) connected to a coaxial base 10.

The band pass filter in accordance with the invention makes it possible in particular to connect several transmitters or receivers working on different frequencies to a single aerial. The area of application of such a filter is nonetheless much broader in the field of telecommunications, and another application may be made, for example, in the area of eliminating parasite noises.

We claim:

1. Band pass filter tunable to a predetermined number of discrete frequencies spread over a broad frequency band, comprising at least one resonant coaxial cavity defined by an external conductor, wherein at least one of the internal and external conductors of the coaxial cavity is divided into sections separated by breaks having the form of annular slits whose thickness is very slight in relation to the wave length corresponding to the average frequency of the pass band and each section comprises at least one reactive tuning element, constituted by a revolution cavity formed in sections of internal or external conductor in order to make an open or short-circuited coaxial line with transversal and axial dimensions greatly in excess of the thickness of a break, but small in relation to the wave length corresponding to the average frequency of the pass band, and at least one switch element located in the vicinity of the break of the corresponding section in order selectively to short-circuit the said break or bring about the insertion of the reactive tuning element of the corresponding section in response to electronic control devices.

2. Band pass filter tunable to a predetermined number of discrete frequencies spread over a broad frequency band, comprising at least one resonant coaxial cavity defined by an external conductor and an internal conductor, wherein at least one of the internal and external conductors of the coaxial cavity is divided into sections separated by breaks having the form of annular slits whose thickness is very slight in relation to the wave length corresponding to the average frequency of the pass band and each section comprises at least one reactive tuning element, constituted by a revolution cavity formed in sections of internal or external conductor in order to make an open or short-circuited coaxial line with transversal and axial dimensions greatly in excess of the thickness of a break, but small in relation to the wave length corresponding to the average frequency of the pass band, and at least one switch element located in the vicinity of the break of the corresponding section in order selectively to short-circuit the said break or being about the insertion of the reactive tuning element of the corresponding section in response to electronic control devices, and wherein the switch elements are actuated by direct current by means of insulated conducting wires which are uncoupled from the high frequency and incorporated in the internal or external conductors.

3. Band pass filter tunable to a predetermined number of discrete frequencies spread over a broad frequency band, comprising at least one resonant coaxial cavity defined by an external conductor and an internal conductor, wherein at least one of the internal and external conductors of the coaxial cavity is divided into sections separated by breaks having the form of annular slits whose thickness is very slight in relation to the wave length corresponding to the average frequency of the pass band and each section comprises at least one reactive tuning element, constituted by a revolution cavity formed in sections of internal or external conductor in order to make an open or short-circuited coaxial line with transversal and axial dimensions greatly in excess of the thickness of a break, but small in relation to the wave length corresponding to the average frequency of the pass band, and at least one switch element located in the vicinity of the break of the corresponding section in order selectively to short-circuit the said break or bring about the insertion of the reactive tuning element of the corresponding section in response to electronic control devices, and wherein the external conductor and internal conductor of the coaxial cavity are comprised by superimposed metallic elements which are screwed into one another.

4. Filter according to claim 3, wherein for each section there are several switch elements fed with power in parallel arranged at regular intervals along the break in order to short circuit the said break or to insert a reactive element.

5. Filter according to claim 3, wherein the switch elements are constituted by electromagnetic relays whose dimensions are small with respect to the average operational wave length and which are located in the immediate vicinity of the annular slits constituting the breaks between sections.

6. Filter according to claim 3, wherein the switch elements are constituted by PIN diodes located in the immediate vicinity of the annular slits constituting the breaks between sections.

7. Band pass filter tunable to a predetermined number of discrete frequencies spread over a broad frequency band, comprising at least one resonant coaxial cavity defined by an external conductor and an internal conductor, wherein at least one of the internal and external conductors of the coaxial cavity is divided into sections separated by breaks having the form of annular slits whose thickness is very slight in relation to the wave length corresponding to the average frequency of the pass band and each section comprises at least one reactive tuning element, constituted by a revolution cavity formed in sections of internal or external conductor in order to make an open or short-circuited coaxial line with transversal and axial dimensions greatly in excess of the thickness of a break, but small in relation to the wave length corresponding to the average frequency of the pass band, and at least one switch element located in the vicinity of the break of the corresponding section in order selectively to short-circuit the said break or bring about the insertion of the reactive tuning element of the corresponding section in response to electronic control devices, and wherein the dimensions of the coaxial cavity, of the reactive elements of the N sections, and the position of the N breaks are determined in such a way as to define an approximately constant law f/f, where f designates any one of the $2^N$ discrete tuning frequencies obtained by the selective insertion of the N reactive elements and f represents the average difference between the said frequency f and the adjacent frequencies from among the $2^N$ possible frequencies.

* * * * *

UNITED STATES PATENT AND TRADEMARK OFFICE

CERTIFICATE OF CORRECTION

PATENT NO. : 4,472,695

DATED : September 18, 1984

INVENTOR(S) : Gilles Beauquet, et al

It is certified that error appears in the above-identified patent and that said Letters Patent are hereby corrected as shown below:

Column 7, line 8, "being" should be --bring--.

Signed and Sealed this

*Sixteenth* Day of *April 1985*

[SEAL]

*Attest:*

DONALD J. QUIGG

*Attesting Officer* *Acting Commissioner of Patents and Trademarks*